United States Patent [19]

Manabe et al.

[11] 4,354,092

[45] Oct. 12, 1982

[54] ELECTRIC HAIR CURLING IRON WITH RECHARGEABLE BATTERY POWER SUPPLY

[75] Inventors: Keiji Manabe, Neyagawa; Tadanori Kawamura, Katano; Masao Fukunaga, Matsubara; Takeo Nishida, Osaka; Seishi Terakado, Toyonaka; Toshiaki Nagakoshi, Hyogo, all of Japan

[73] Assignee: Matsushita Electric Industrial Co., Ltd., Kadoma, Japan

[21] Appl. No.: 80,773

[22] Filed: Sep. 28, 1979

[30] Foreign Application Priority Data

Oct. 5, 1978 [JP] Japan ..... 53-123162

[51] Int. Cl.[3] ..... A45D 1/04; H05B 1/02; H05B 3/10

[52] U.S. Cl. ..... 219/225; 132/31 R; 132/37 R; 219/240; 219/242; 219/505; 219/506; 219/533; 219/543; 320/2

[58] Field of Search ..... 219/222–226, 219/240, 506, 242, 533, 504, 505, 543; 320/2; 132/37 R, 37 A, 31 R, 31 A, 32 R, 32 A

[56] References Cited

U.S. PATENT DOCUMENTS

| | | | |
|---|---|---|---|
| 2,414,351 | 1/1947 | Bender | 219/523 |
| 2,861,163 | 11/1958 | Asakawa | 219/504 X |
| 3,114,819 | 12/1963 | Woodling | 219/505 X |
| 3,243,753 | 3/1966 | Kohler | 219/241 X |
| 3,287,684 | 11/1966 | Armbruster | 219/543 X |
| 3,560,703 | 2/1971 | Chedister | 219/222 |
| 3,603,765 | 9/1971 | Underwood | 219/222 |
| 3,617,694 | 11/1971 | D'Entremont | 219/222 |
| 4,029,954 | 6/1977 | Moyer | 320/2 X |
| 4,074,110 | 2/1978 | Slaughter | 219/240 |
| 4,097,718 | 6/1978 | Weise | 219/505 X |
| 4,151,401 | 4/1979 | Van Bokestal et al. | 219/222 X |

FOREIGN PATENT DOCUMENTS

| | | | |
|---|---|---|---|
| 2412060 | 9/1975 | Fed. Rep. of Germany | 219/240 |
| 2504237 | 8/1976 | Fed. Rep. of Germany . | |
| 7010679 | 3/1977 | Fed. Rep. of Germany . | |
| 1401882 | 4/1965 | France . | |
| 1553082 | 12/1968 | France | 219/225 |
| 1326121 | 8/1973 | United Kingdom | 219/225 |
| 1375768 | 11/1974 | United Kingdom | 219/225 |

*Primary Examiner*—A. Bartis

*Attorney, Agent, or Firm*—Cushman, Darby & Cushman

[57] ABSTRACT

An electrically heated hair curling iron includes a sheet-shaped heater with electrodes affixed to an electrically resistive layer, wrapped around an elongated cylindrical support, and capable of being rapidly heated and maintained hot by electric current available from a rechargeable storage battery. The resistive layer has a positive temperature coefficient of resistance so that its temperature is self limiting. The storage battery is contained in a handle attached to the cylindrical support, and a battery charger is disclosed which comes into electrical contact with the battery when the handle is inserted in a cavity located in the battery charger. An elongated longitudinal clip is used to retain the hair in contact with the heater; a removable cap protects the heater and clip when the iron is not in use, and also engages a switch which ensures that the iron does not remain on. The charger and the curling iron are each provided with an LED to indicator operation of the charger and state of charge of the battery, respectively.

12 Claims, 16 Drawing Figures

ELECTRIC HAIR CURLING IRON WITH RECHARGEABLE BATTERY POWER SUPPLY

BACKGROUND OF THE INVENTION

1. Field of the Invention

This invention relates to an electric hair iron for hair curling.

2. Description of Prior Art

Hitherto, for electric hair iron, two different types are known, one of which uses a heater directly connected to the commercial AC line (hereinafter referred to as an AC line type hair iron) and the other uses a heat-storing body which keeps heat after heating (hereinafter referred to as a heat-storing type hair iron). The AC line type hair iron cannot be used an without AC line and lacks portability. The heat-storing type hair iron can be used only for a short time after disconnection from the AC line, and therefore lacks portability. Furthermore, each of these two types of hair irons has such a construction that the heater is made in a slim shape and inserted in a metal tube of the hair iron. In such construction, it is not easy to contact the heater and the metal tube in a good heat conducting relation, and therefore considerable time elapses between energization of the heater and attainment of a heated state.

SUMMARY OF THE INVENTION

The present invention is a hair iron having a portable and simple design. A sheet-shaped heater is wrapped around an elongated cylindrical supporting member and electrically connected to a rechargeable battery contained in a handle attached to the cylindrical supporting member. The heater has a layer comprised of a material exhibiting a positive temperature coefficient of resistance so that the temperature it attains is self-limiting. The rechargeable battery is recharged by inserting the handle containing it into a cavity provided in a battery charger, thus causing the mating of electrical contacts connected to the battery and to the charger. The hair curling iron according to the present invention is also provided with a removable cap which protects the sheet heater and an associated elongated longitudinal clip which retains the hair in contact with the sheet heater. When the cap is placed on the curling iron, it engages a switch in such a way as to prevent the iron from inadvertently being left on when not in use. An LED indicates operation of the hair curling iron.

DETAILED DESCRIPTION OF PREFERRED EMBODIMENT

The electric hair iron in accordance with the present invention comprises:

- a main part containing a rechargeable storage battery therein and having a connecting means for charging the storage battery,
- an ironing part having a heat conductive envelope and an electric heater, the substrate of which forms a surface of the ironing part for generating heat by consuming electric energy of the storage battery,
- a clip which is movably provided for holding hair on the ironing part, and
- a switch which is provided in the main part for connection and disconnection of the storage battery to the heater.

Figure 1:
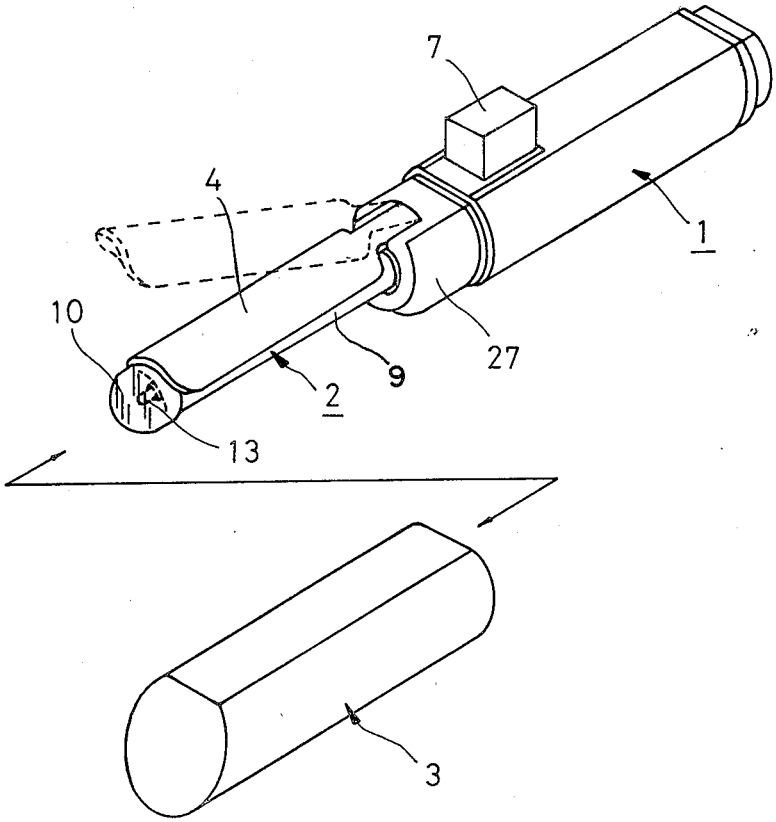
FIG. 1 is a perspective view of an electric hair iron embodying the present invention.
Figure 2A:
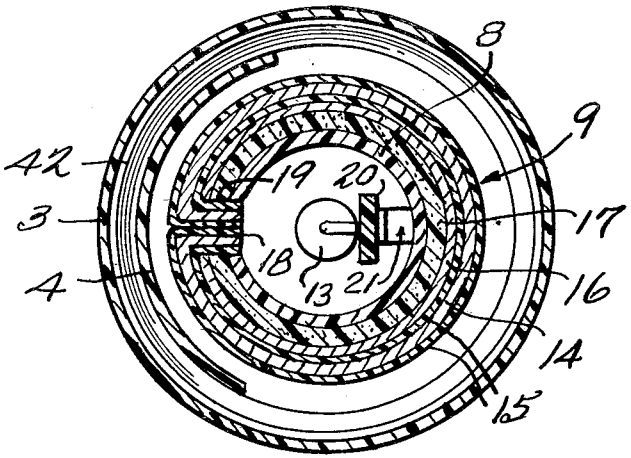
FIG. 2(A) is a sectional view at the plane IIA—IIA shown in FIG. 2(B).
Figure 6:
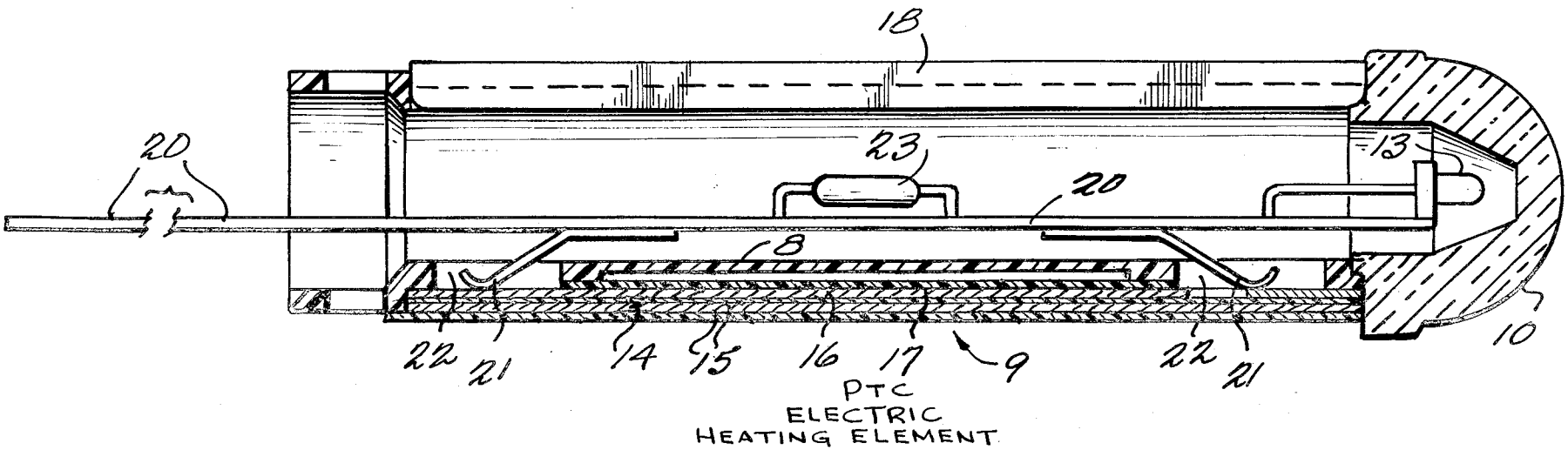
FIG. 6 is a cross-sectional view of the ironing part of the electric hair iron of FIG. 1.
Figure 2B:
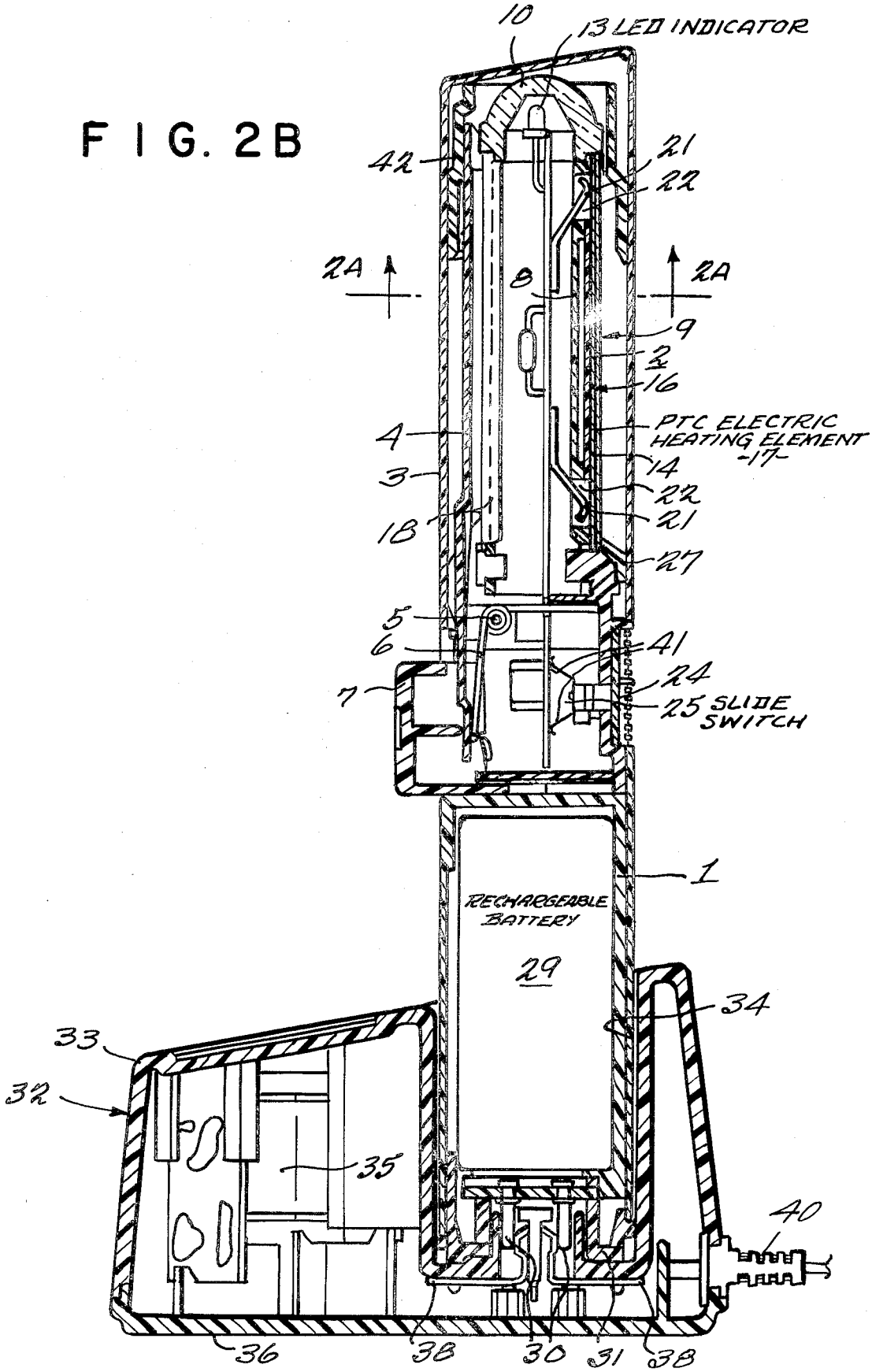
FIG. 2(B) is a sectional elevation view of the electric hair iron of FIG. 1 and a charger of one of embodiments of the present invention.
Figure 3:
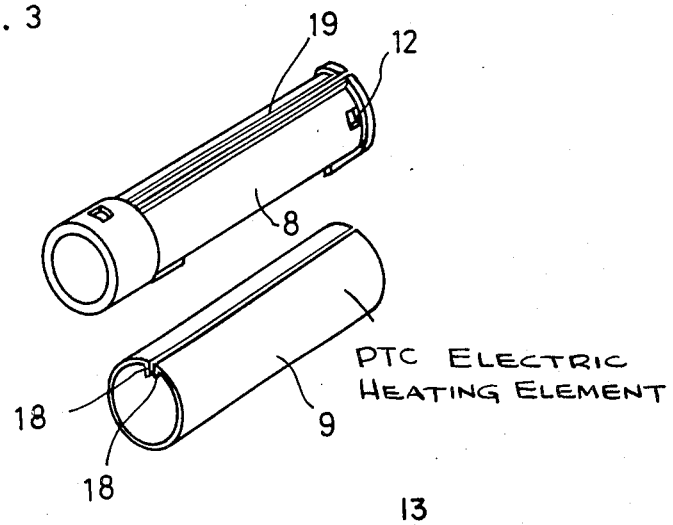
FIG. 3 is an exploded perspective view of a sheet heater and a holder thereof.
Figure 4:
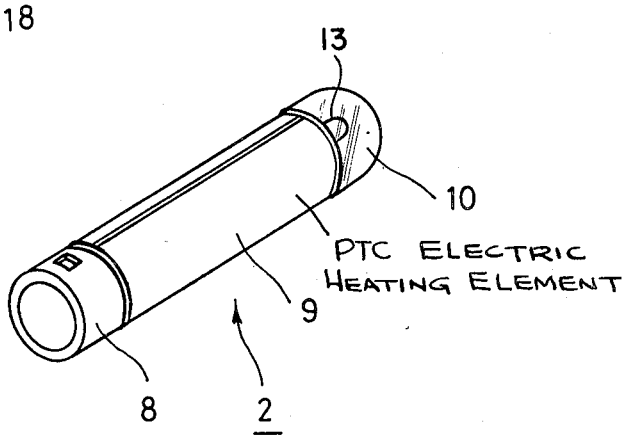
FIG. 4 is a perspective view of a ironing part of the electric hair iron of FIG. 1.
Figure 5:
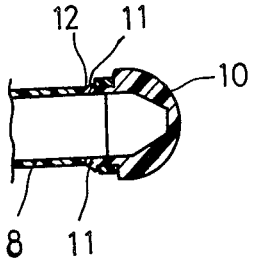
FIG. 5 is a cross-sectional view of top end of the ironing part of the electric hair iron of FIG. 1.
Figure 7:
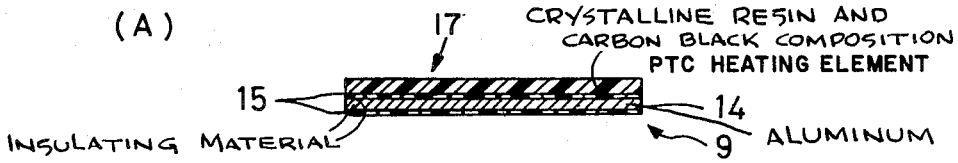
FIG. 7(A) and FIG. 7(B) are a perspective view and a sectional view, respectively, of a heater of the electric hair iron of FIG. 1.
Figure 7:
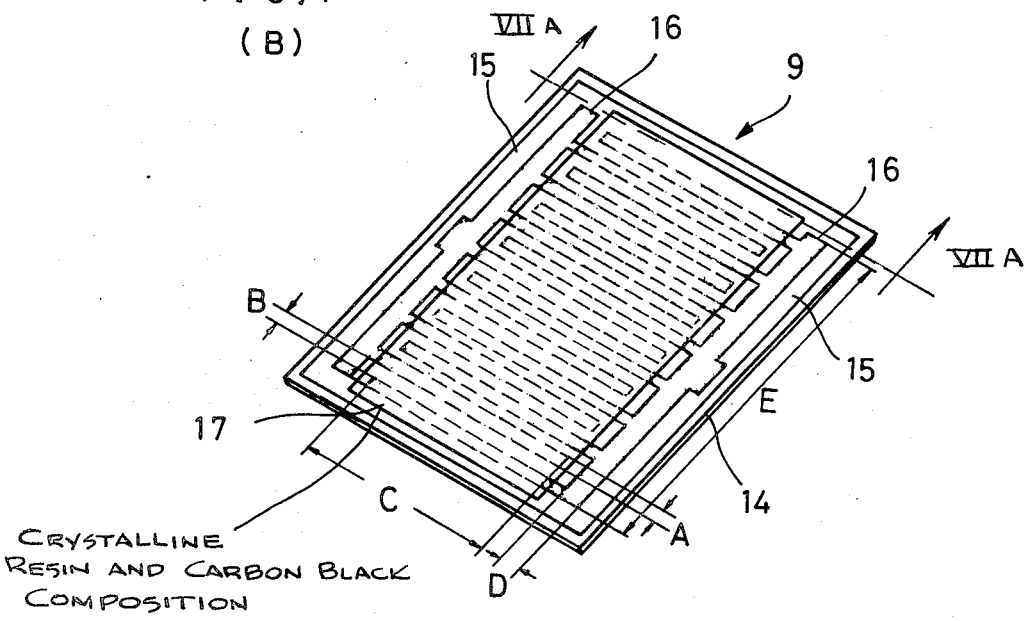

FIG. 1 shows an electric hair iron embodying the present invention. The electric hair iron comprises a main part or a handle part 1 which contains a storage battery therein, an ironing part 2 and a cap 3. The cap 3 is inserted in a cap insertion part 27 of the main part 1 and protects the ironing part 2. An inner cap part 42 protects the tip of ironing part 2, and is provided with a hole through which a nipple in top cover 10 protrudes. The ironing part 2 is cylindrical so that hair may be wound around it and is connected by its one end to the main part 1. A clip 4 is shaped to have a section of an arc shape so as to fit along the ironing part 2. In FIG. 2B, the clip 4 is movably held by a pin 5 to the main part 1 and is pressed against the ironing part 2 by a spring 6. The main part 1 comprises a push button 7 to be pressed by a finger of a user thereby to press a push end of the clip 4 against the force of the spring 6. When the user pushes the push button 7 against the elasticity of the spring 6, the clip 4 gradually shifts, parting from the ironing part to a predetermined position as shown by an interrupted line of FIG. 1. A rechargeable storage battery 29, for example a Ni-Cd battery, is provided in the main part 1 for feeding electric power to a sheet heater 9. FIGS. 3, 4 and 5 show the ironing part 2 of the present invention. A heater-holding member 8 is made of plastic, shaped in a tube and has a narrow slit 19 parallel to its axis. The sheet heater 9 is rolled into a tube and is bent in a right angle at both ends 18, 18 thereof as shown on FIG. 3. The heater holding member 8 is inserted into the rolled sheet heater 9 and holds the bent ends 18, 18 of the sheet heater 9 in the slit 19. A top cover 10 of the ironing part 2 is made of transparent resin and is secured at the top of the heater-holding member 8 by engaging projecting parts 11 of the top cover 10 with openings 12, 12 of the heater-holding member 8 as shown on FIGS. 3 and 5. FIG. 6 shows an inner side of the ironing part 2. In FIG. 6, the heater-holding member 8 holds a printed circuit board 20, on which is provided a light emitting diode (LED) 13 for indicating an energizing state of the heater, a resistor 23, and springy connecting tips 21, 21. The springy connecting tips 21, 21 contact the electrodes 16 (see FIG. 7) of the sheet heater 9 through openings 22, 22 of the heater-holding member 8 by the elasticity thereof and feed electric power to the sheet heater 9 therefrom. The resistor 23 is connected in series to the LED 13.

As shown in FIGS. 7(A) and (B), the sheet heater 9 comprises an aluminum substrate 14, on which are provided thin insulation films 15, two interdigitated comb-shaped Ag electrodes 16 and a film of a resistance material 17 in the described order. The sheet heater 9 is rolled into the tubular shape as abovementioned with the face printed with the Ag electrodes 16 and the resistance material 17 inside. The resistance material 17 has a positive temperature coefficient of resistance (PTC), and thereby the temperature of the resistance material 17 is automatically regulated at a predetermined value.

To describe sheet heater 9 in more detail, the aluminum substrate 14 of sheet heater 9 is about 0.2 mm thick. A polyester film about 25 μm thick is affixed to each face of substrate 14 by means of a hot melt adhesive. A width A of the comb teeth of the Ag electrodes 16, a gap B between the neighboring opposite Ag electrodes 16, a length C of the teeth part of the Ag electrodes 16, and a width D and length E of the base parts of the Ag electrodes 16 are determined 0.6 mm, 0.4 mm, 45 mm, 5 mm and 50 mm, respectively. The number of the teeth of the Ag electrodes 16 is 25 on each of the opposing comb shape electrodes 16, and the dimensions and shape of the aluminum substrate 14 are 60 mm×60 mm and square. Each Ag electrode 16 is made of a low resistance silver paste which is made by blending a high-hardening epoxy resin and an elastic epoxy resin in a volume ratio of 1:1 to form a binder, and then by blending silver powder therein to a volume of 80% of the blended binder. The resistance material 17 comprises a resistance paste that is prepared by grinding a mixture of a crystalline resin (e.g. ethylene vinylacetate copolymer) and furnace carbon black in the weight ratio of 2:3, by using ethylene-prophylene rubber or another rubber as binder, together with a high boiling point solvent (e.g. tetrahydronaphthalene). The resistance material 17 is printed and baked on the Ag electrodes 16. The abovementioned sheet heater 9 has about an average temperature coefficient of resistance of 0.08° C.$^{-1}$ at 70°-80° C., and it attains a saturation temperature of 80° C. on applying 2.4 V power source.

Figure 8:
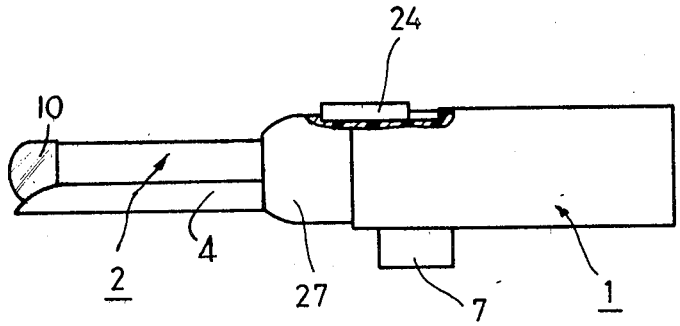
FIG. 8(A) and FIG. 8(B) are schematic views showing the operation of a switch knob of the electric hair iron of FIG. 1.
Figure 8:
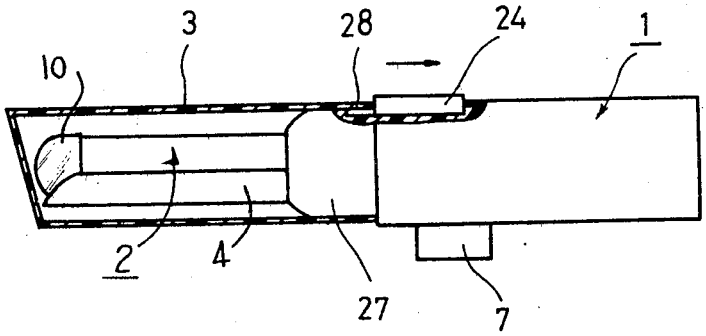

FIGS. 8A and 8B show a knob 24 of a slide switch 25 provided in the main part 1 on the opposite side of the push button 7. The slide switch 25 controls the flow of electric power of from storage battery 29. As shown in FIG. 2B, the switch 25 has springy contacts 41 which slidably contact the circuit board 20 at location 26. FIG. 8(A) shows "on" state configuration and (B) shows an "off" state configuration. When the slide switch 25 remains "on" and the user covers the ironing part with the cap 3, an end part 28 of cap 3 engages knob 24, thus sliding knob 24 to cause switch 25 to be placed in an open position in response to placement of cap 3 on the ironing part.

Figure 9:
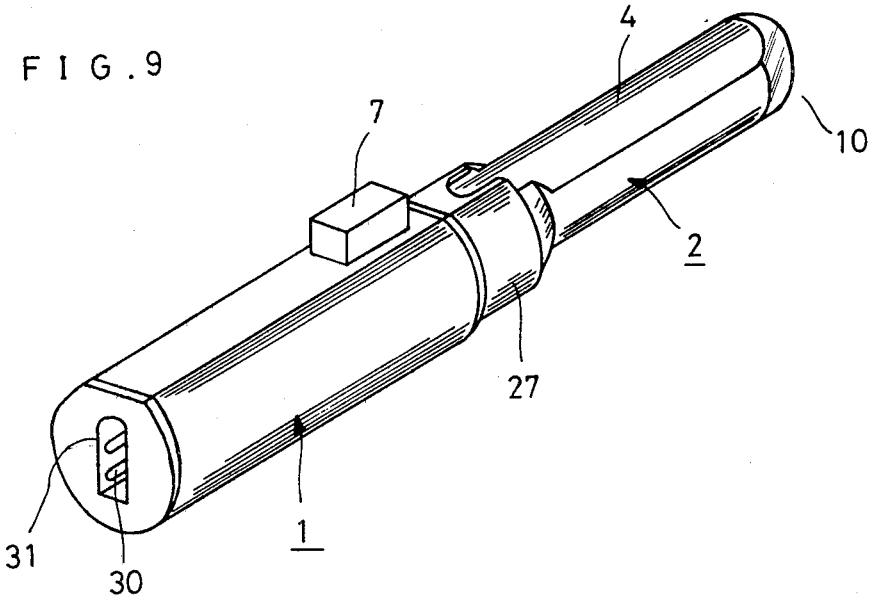
FIG. 9 is a perspective view showing a rear part of the electric hair iron of FIG. 1.

FIG. 9 shows a rear view of the main part 1. A connector socket 31 including two connecting terminals 30 is provided at the bottom of the main part 1.

Figure 10:
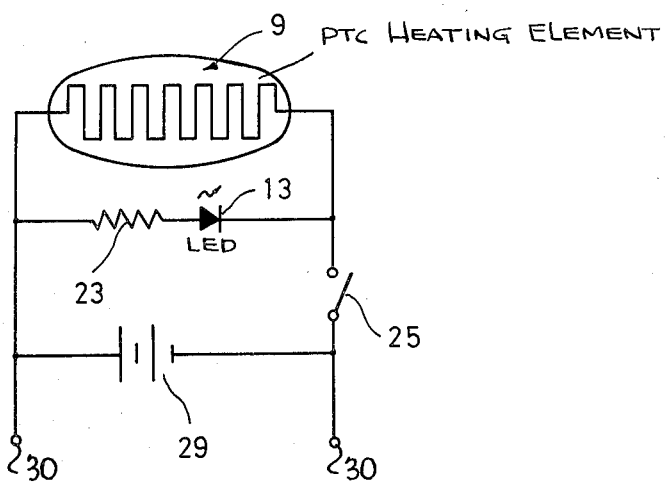
FIGS. 10 and 12 are wiring diagrams of the electric hair iron and the charger of FIGS. 1 and 2, respectively.
Figure 11:
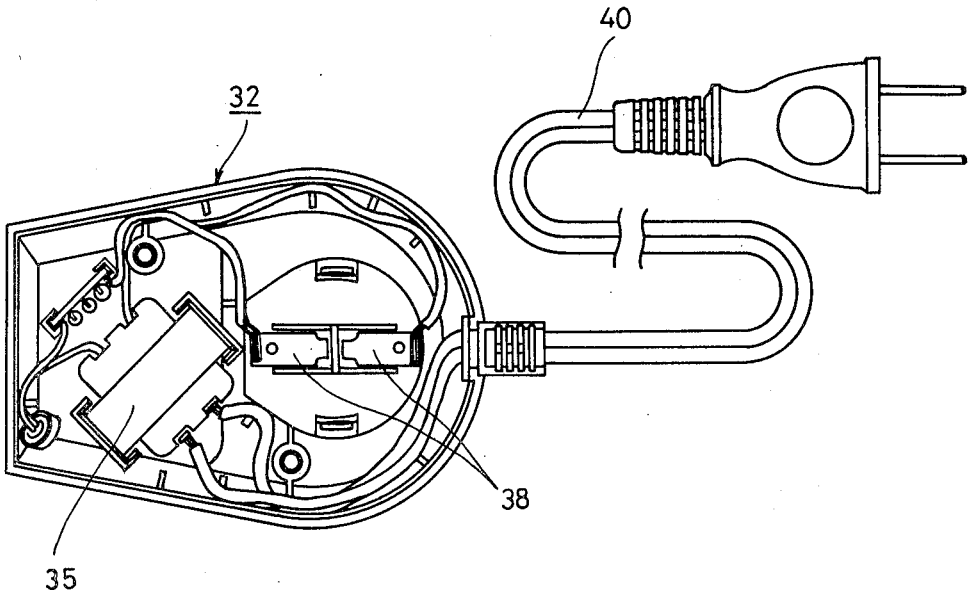
FIG. 11 is a bottom view of the charger, with a bottom plate thereof removed to show the inside construction thereof, of the apparatus of FIG. 2.

A circuit diagram of the present embodiment is shown on FIG. 10. The series-connected resistor 23 and the LED 13 are connected in parallel with the sheet heater 9, and are further connected to the storage battery 29 through the slide switch 25. The connecting terminals 30 are for feeding electric power to the storage battery 29 from the charger 32.

Figure 12:
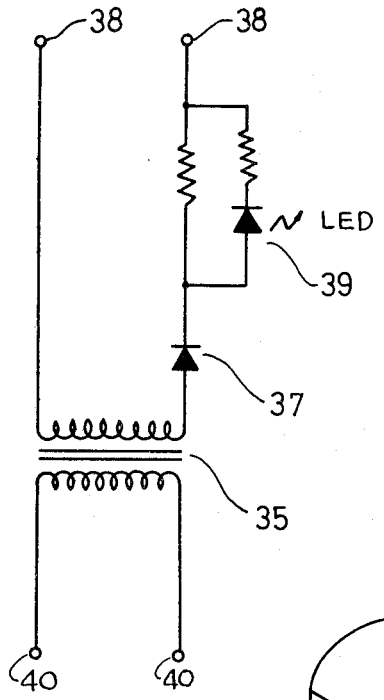

Next, elucidation is made of the charger 32 in reference to FIGS. 2B, 11, 12, and 13. A main body 33 of the charger 32 has a cavity 34 for receiving the main part of the hair iron, and includes electric circuit components for charging the storage battery 29 in the main body of the hair iron. Namely, a transformer 35 is disposed in the main body 33 and is fixed by a rear cover 36. In FIG. 12, the primary winding of the transformer 35 is connected to the commercial AC line. The transformer 35 feeds a low voltage from its secondary winding which is connected to a rectifier circuit comprising a diode 37 for rectification. A rectified voltage is fed to the storage battery 29 through two terminals 38, 38. An LED 39 and a resistor are connected in series across another resistor. This parallel combination is connected in series between the cathode of diode 37 and battery terminal 38 for indication of charging, and is disposed on the surface of the main body 33 as shown on FIG. 13. The terminals 38, 38 are disposed on the bottom of the cavity 34 and are fixed by the rear cover 36. An electric cord 40 feeds electric power to the transformer 35.

OPERATION

Figure 13:
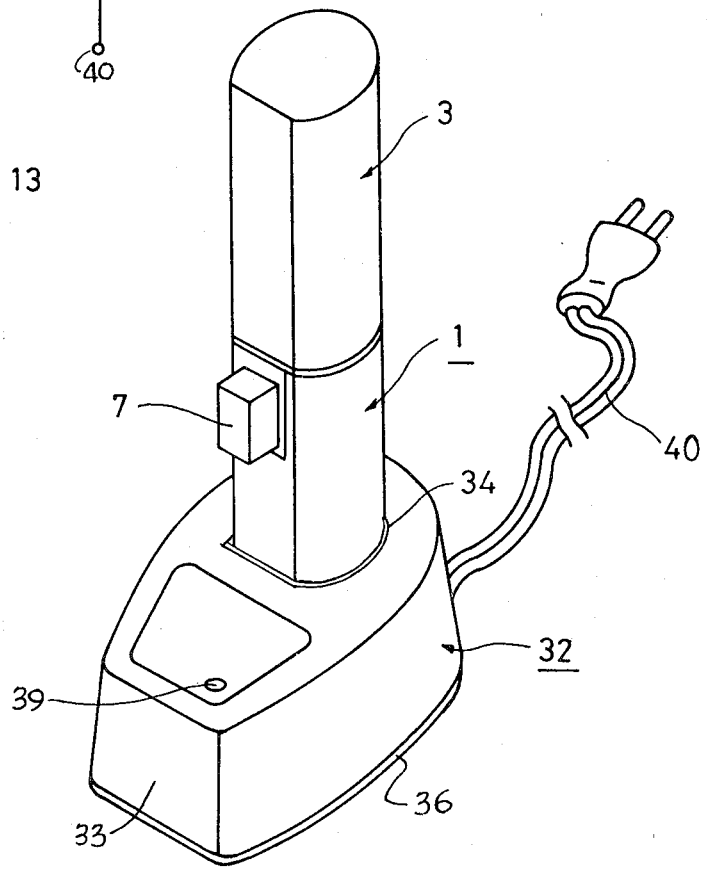
FIG. 13 is a perspective view of FIG. 2.

To begin with, the main part 1 of the electric hair iron is inserted into the cavity 34 of the charger 32 as shown on FIG. 13, in order to charge the storage battery 29. By this insertion, the connection terminals 30, 30 of the hair iron are connected to the terminals 38, 38 of the charger 32, and the charger 32 feeds electric power to the storage battery 29. At the same time, the LED 39 of the charger 32 is lit and indicates that the charging is properly operated. After completion of the charging, the user takes the hair iron from the charger 32 thus extinguishing LED 39. After removing cap 3, the user moves slide switch 25 to the "on" position. At that time, the LED 13 of the hair iron is lit to indicate that the storage battery has been sufficiently charged, and is ready for use. If the storage battery 29 is not charged enough, the LED does not illuminate. Eventually after switching on, the sheet heater 9 gets hot and reaches a predetermined temperature and is kept at this temperature due to its positive resistance-temperature characteristic. Then the user pushes the push button 7 and opens the clip 4, and winds her hair around the ironing part 2. The wound hair is pinched and held by the clip 4, because the clip 4 returns by the force of the spring 6 to the former position by releasing the push button 7. Thus the wound hair is ironed and easily curled merely by keeping the hair wound around the hair iron. Since the temperature of the sheet heater 9 is automatically regulated, the user can use the hair iron with safety and without any fear of injuring or burning the hair.

After several uses, the charge of the storage battery 29 is consumed, and the current flowing through the LED 13 decreases. Eventually, the LED 13 fails to light, thus that recharging of the storage battery 29 is necessary.

As described above, the electric hair iron of the present invention is compact and need not be connected to the AC line as it uses a storage battery as a power source, and therefore is very convenient for carrying and dressing hair by a simple operation. Furthermore, due to the automatic temperature controlling by utilizing resistance body of positive resistance temperature coefficient the safety of temperature is assured. Furthermore, since the LED indicates whether the apparatus is in usable state, it is easy for the user to know when charging becomes necessary, and therefore, an overdischarge of the storage battery is prevented and accordingly the life of the storage battery is lengthened.

What we claim is:

1. An electric hair iron comprising an elongated electrically heated ironing part for ironing the hair, said ironing part being disposed at the end of a handle part for manipulation of said ironing part, characterized in that said handle part contains a rechargeable storage battery therein and has electrical connecting means for electrically connecting said storage battery to a battery charger, said ironing part comprising an electric sheet heater of elongated tubular shape, said sheet heater including a layer of resistance material exhibiting a positive temperature coefficient of resistance whereby the temperature of the ironing part is automatically regulated, said tubular sheet heater forming the outside hair contacting surface of the ironing part, wherein said tubular sheet heater comprises a tubular metal substrate, the inner and outer surfaces of which are coated with electrical insulation, and having spaced electrodes on the inner electrical insulation, said layer of resistance material being formed on said electrodes, an elongated longitudinally extending hair clip connected to said handle part so that said clip may pivot about an axis perpendicular to the axis of said ironing part for holding hair on said ironing part, and means including a switch provided in said handle part for connection and disconnection of said storage battery to said heater.

2. An electric hair iron in accordance with claim 1, wherein said ironing part has an elongated cylindrical plastic heater-holding member which is attached to said handle part and is inserted into said tubular sheet heater to hold said sheet heater with said sheet heater outside of said heater holding member.

3. An electric hair iron in accordance with claim 1, wherein said clip is pivotally held by a pin on said handle part, and a button to operate said clip is provided in said handle part.

4. An electric hair iron in accordance with claim 1, combined with a charger adapted to hold said handle part and charge said storage battery through said electrical connecting means in said handle part, and having a display device which indicates the operation of the charger.

5. An electric hair iron comprising an elongated electrically heated ironing part for ironing the hair, said ironing part being disposed at the end of a handle part for manipulation of said ironing part, said handle part containing a rechargeable storage battery and electrical connecting means for electrically connecting said storage battery to a battery charger, and said ironing part comprising:

an electric sheet heater of elongated tubular shape, said sheet heater including a layer of resistance material exhibiting a positive temperature coefficient of resistance whereby the temperature of the ironing part is automatically regulated, said tubular sheet forming the outside contacting surface of the ironing part, wherein said tubular sheet heater comprises a tubular aluminum substrate, the inner and outer surfaces of which are coated with insulating films, and having spaced Ag electrodes on the inner insulting film, said layer of resistance material being formed on the Ag electrodes, an elongated longitudinally extending hair clip connected to said handle part so that said clip may pivot about an axis perpendicular to the axis of said ironing part for holding hair on said ironing part, and means including a switch provided in said handle part for connection and disconnection of said storage battery to said heater, said electrodes being connected to said battery by means of said switch.

6. An electric hair iron in accordance with claim 5, wherein said insulating films comprise a polyester film, said Ag electrodes consist of comb shaped silver-paste members interdigitated with each other and printed on one of said insulating films, and said layer of resistance material is a mixture of conductive carbon black and crystalline resin of a binder and a solvent.

7. An electric hair iron comprising an elongated electrically heated ironing part for ironing the hair, said ironing part being disposed at the end of a handle part for manipulating said ironing part, said handle part containing a rechargeable storage battery and electrical connecting means for electrically connecting said storage battery to a battery charger, said ironing part comprising:

an electric sheet heater of elongated tubular shape, said sheet feeder including a layer of resistance material exhibiting a positive temperature coefficient of resistance whereby the temperature of the ironing part is automatically regulated, said tubular sheet forming the outside contacting surface of the ironing part, an elongated longitudinally extending hair clip connected to said handle part so that said clip may pivot about an axis perpendicular to the axis of said ironing part for holding hair on said ironing part, means including a switch provided in said handle part for connection and disconnection of said storage battery to said heater, and an elongated cylindrical plastic heater-holding member attached to said handle part and inserted into said tubular sheet heater to hold said sheet heater with said sheet heater outside of said heater-holding member, said heater-holding member having a slit parallel to the axis of said heater-holding member and said tubular sheet heater disposed around said heater-holding member being split lengthwise to form a pair of juxtaposed ends and being held by insertion of said juxtaposed ends into said slit.

8. An electric hair iron comprising an elongated electrically heated ironing part for ironing the hair, said ironing part being disposed at the end of a handle part for the manipulation of said ironing part, said handle part containing a rechargeable storage battery and electrical connecting means for electrically connecting said storage battery to a battery charger, and said ironing part comprising:

an electric sheet heater of elongated tubular shape, said sheet heater including a layer of resistance material exhibiting a positive temperature coefficient of resistance whereby the temperature of the ironing part is automatically regulated, said tubular sheet forming the outside contacting surface of the ironing part, an elongated longitudinally extending hair clip connected to said handle part so that said clip may pivot about an axis perpendicular to the axis of said ironing part for holding hair on said ironing part, means including a switch provided in said handle part for connection and disconnection of said storage battery to said heater, an elongated cylindrical plastic heater-holding member which is attached to said handle part and is inserted into said tubular sheet heater with said sheet heater outside of said heater-holding member, and a display device which indicates heating and warning a decrease in the electric charge of said storage battery provided on the end of said ironing part, opposite of said handle part, said display device being electrically connected with said tubular sheet heater.

9. An electric hair iron in accordance with claim 8, wherein a transparent end cover on said ironing part covers said display device and is attached to said ironing part by projecting parts thereof.

10. An electric hair iron comprising an elongated electrically heated ironing part for ironing the hair, said ironing part being disposed at the end of a handle part for the manipulation of the ironing part, said handle part containing a rechargeable storage battery and electrical connecting means for electrically connecting said storage battery to a battery charger, and said ironing part comprising:

an electric sheet heater of elongated tubular shape, said sheet heater including a layer of resistance material exhibiting a positive temperature coefficient of resistance whereby the temperature of the ironing part is automatically regulated, said tubular sheet forming the outside contacting surface of the ironing part, an elongated longitudinally extending hair clip connected to said handle part so that said clip may pivot about an axis perpendicular to the axis of said ironing part for holding hair on said ironing part, means including a switch provided in said handle part for connection and disconnection of said storage battery to said heater, an elongated cylindrical plastic heater-holding member attached to said handle part and inserted into said tubular sheet heater with said sheet heater outside of said heater-holding member, a printed circuit board provided in said heater-holding member and electrically connected to said storage battery through said switch, and springy connecting tips disposed on said printed circuit board press on said sheet heater for feeding electric power thereto.

11. An electric hair iron in accordance with claim 10, wherein said switch is a slide switch comprising a movable contact and copper film on said printed circuit board, said movable contact touching said copper film when the switch is turned on.

12. An electric hair iron comprising an elongated electrically heated ironing part for ironing hair, said ironing part being disposed at the end of a handle part for the manipulation of the ironing part, said handle part containing a rechargeable storage battery and electrical connecting means for electrically connecting the storage battery to a battery charger, said ironing part comprising:

an electric sheet heater of elongated tubular shape, said sheet heater including a layer of resistance material exhibiting a positive temperature coefficient of resistance whereby the temperature of the ironing part is automatically regulated, said tubular sheet forming the outside contacting surface of said ironing part, an elongated longitudinally extending hair clip connected to said handle part so that said clip may pivot about an axis perpendicular to the axis of the ironing part for holding hair on the ironing part, means including a switch provided in said handle part for connection and disconnection of said storage battery to said heater, said electric hair iron further comprising a removable cover cap disposed over said ironing part and said clip, attached to said handle part and being connected to said handle part when so disposed, and a movable operating knob of said switch located at the connecting position of said cap and said handle part in a manner that said knob juts out of said handle part when said cap is removed and said switch is closed, and said knob is automatically moved to open said switch in response to attachment of said cap to said handle part in covering relationship to said ironing part and clip.

* * * * *